US006358159B1

(12) United States Patent
Yamagishi et al.

(10) Patent No.: US 6,358,159 B1
(45) Date of Patent: Mar. 19, 2002

(54) MULTI-PIECE SOLID GOLF BALL

(75) Inventors: Hisashi Yamagishi; Hiroshi Higuchi; Junji Hayashi; Hideo Watanabe; Atsushi Nakamura, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/369,024

(22) Filed: Aug. 6, 1999

(30) Foreign Application Priority Data

Aug. 7, 1998 (JP) ..... 10-224698
Aug. 7, 1998 (JP) ..... 10-224704
Aug. 7, 1998 (JP) ..... 10-224711

(51) Int. Cl.[7] ..... A63B 37/06
(52) U.S. Cl. ..... 473/374; 473/376
(58) Field of Search ..... 473/373, 374, 473/377, 378

(56) References Cited

FOREIGN PATENT DOCUMENTS

| | | | |
|---|---|---|---|
| GB | 2300574 | | 11/1996 |
| GB | 2300574 A | * | 11/1996 |
| GB | 2302035 | | 1/1997 |
| GB | 2302035 A | * | 1/1997 |
| GB | 2306118 | | 4/1997 |
| GB | 2316626 | | 3/1998 |
| GB | 2335368 A | * | 9/1999 |
| GB | 2335368 | | 9/1999 |
| JP | 57-25867 | | 2/1982 |
| JP | 60-210272 | | 12/1985 |
| JP | 61-290969 | | 12/1986 |
| JP | 5-73427 | | 10/1993 |
| JP | 6-277312 | | 10/1994 |

* cited by examiner

*Primary Examiner*—Mark S. Graham
*Assistant Examiner*—Raeann Gordon
(74) *Attorney, Agent, or Firm*—Sughrue Mion, PLLC

(57) ABSTRACT

In a golf ball comprising a core, an intermediate layer of one or more layers around the core, and a cover formed mainly of a thermoplastic resin around the intermediate layer, the core is formed mainly of a rubber base and has a deflection of 3–8 mm under a load of 100 kg, and at least one layer of the intermediate layer and the cover contains 100 parts by weight of a resin component and 5–40 parts by weight of an inorganic filler. Alternatively, in a golf ball comprising a core, an optional intermediate layer, and a cover of two or more layers, the outermost layer of the cover contains 100 parts by weight of a thermoplastic resin base component and 10–40 parts by weight of an inorganic filler.

38 Claims, 2 Drawing Sheets

MULTI-PIECE SOLID GOLF BALL

This invention relates to multi-piece solid golf balls having a good feel and improved durability.

BACKGROUND OF THE INVENTION

It is well known in the art to add an inorganic filler to a cover stock as disclosed in JP-B 5-73427, JP-A 6-277312, 57-25867, 60-210272, and 61-290969.

In JP-A-6-277312, for example, an inorganic filler 15 such as titanium oxide or barium sulfate is added to a cover stock to shift the weight distribution within the ball from the core center toward the cover and to increase the inertia moment of the ball itself for preventing the spin of the ball in flight from attenuating. As a consequence, the ball becomes unsusceptible to an initial spin upon impact and travels a longer distance.

All these proposals intend to increase the specific gravity of the cover to increase the inertia moment of the ball for improving flight performance. However, excessive loading of the inorganic filler rather detracts from the resilience or rebound of the ball.

All these proposals intend to increase the specific gravity of the cover to increase the inertia moment of the ball for improving flight performance. However, excessive loading of the inorganic filler detracts from the resilience or rebound of the ball.

A variety of proposals have been made in order to improve the hitting feel of golf balls. Within the range of the prior art, a soft feel is obtained at the sacrifice of durability against consecutive strikes. It is very difficult to find a good compromise between hitting feel and durability against consecutive strikes.

SUMMARY OF THE INVENTION

An object of the invention is to provide a multi-piece solid golf ball having a good feel and improved durability against consecutive strikes.

In a first aspect, the invention provides a golf ball comprising a core, an intermediate layer consisting of one or more layers around the core, and a cover formed mainly of a thermoplastic resin around the intermediate layer. The core is formed mainly of a rubber base and has a deflection of at least 3.0 mm under an applied load of 100 kg. At least one layer of the intermediate layer contains 100 parts by weight of a resin component and 5 to 40 parts by weight of an inorganic filler.

Quite unexpectedly, the core made soft and the intermediate layer having an optimum amount of inorganic filler added cooperate in a synergistic manner so that the hitting feel of the ball becomes soft and pleasant and the durability against consecutive strikes and outer appearance of the ball are improved.

In a second aspect, the invention provides a golf ball comprising a core, an intermediate layer consisting of one or more layers around the core, and a cover formed mainly of a thermoplastic resin around the intermediate layer. The core is formed mainly of a rubber base and has a deflection of at least 3.0 mm under an applied load of 100 kg. At least one layer of the intermediate layer and the cover has added thereto an inorganic filler. The cover has a specific gravity of 1.0 to 1.3.

Also quite unexpectedly, the core made soft and the intermediate layer or cover having an optimum amount of inorganic filler added cooperate in a synergistic manner so that the hitting feel of the ball becomes soft and pleasant and the durability against consecutive strikes of the ball are improved without detracting from the outer appearance of the ball.

In a third aspect, the invention provides a golf ball comprising a core and a cover consisting of at least two layers around the core. The outermost layer of said cover contains 100 parts by weight of a cover stock composed mainly of a thermoplastic resin and 10 to 40 parts by weight of an inorganic filler.

In a fourth aspect, the invention provides a golf ball comprising a core, an intermediate layer around the core, and a cover consisting of at least two layers around the intermediate layer. The outermost layer of the cover contains 100 parts by weight of a cover stock composed mainly of a thermoplastic resin and 10 to 40 parts by weight of an inorganic filler.

The considerations the inventor made on golf balls are described here. (1) A golf ball undergoes a large deformation upon impact. As deformation and restitution are repeated, the ball gradually deforms and eventually fails. During the process, the durability against consecutive strikes of the cover plays a major role. There is a tendency that the harder the cover stock, the faster it fails. This phenomenon is similar to metal fatigue failure. Initially small cracks induced within the cover during molding are deformed and increased in size by consecutive strikes, eventually giving rise to a fatigue failure. (2) Another demand on the golf ball is long distance flight. A harder cover is desirable to this end. The cover contributes to the spin rate upon impact. A harder cover leads to a lower spin rate so that the ball will not sky high beyond the necessity, which is effective for increasing the flight distance. (3) When an inorganic filler is added for the purpose of increasing the flight distance, loading the cover with more inorganic filler is effective. However, a cover stock having a too large content of inorganic filler is likely to induce weld-marks and other defects in outer appearance when injection molded. It is thus desirable to reduce the filler loading of the cover.

Based on the above findings (1) to (3), the inventor made further investigations on a golf ball comprising a core and a cover consisting of at least two layers around the core or a golf ball comprising a core, an intermediate layer around the core and a cover consisting of at least two layers around the intermediate layer. The inventor has found that when the outermost layer of the cover is made of a cover stock based on a thermoplastic resin, 10 to 40 parts by weight of an inorganic filler is added to 100 parts by weight of the outermost layer cover stock, and preferably a spherical body excluding the cover outermost layer has a deflection of at least 3 mm under an applied load of 100 kg, quite unexpectedly, the cover is prevented from fatigue failure without detrimental effect on its outer appearance. There is obtained a multi-piece golf ball exhibiting improved durability against consecutive strikes and a soft pleasant feel when hit.

Unlike the prior art approach of adding an inorganic filler to the cover stock to increase its specific gravity for thereby increasing the inertia moment of the ball and improving the flight performance thereof, the present invention intends to provide a golf ball having a good feel and improved durability against consecutive strikes, which have never been achieved in the prior art approach, by combining a soft core with an intermediate layer and/or a cover each consisting of at least one layer and containing an appropriate amount of uniformly dispersed inorganic filler so that the core and the intermediate layer and/or over cooperate in a synergistic manner.

DESCRIPTION OF THE PREFERRED EMBODIMENTS

Figure 1:
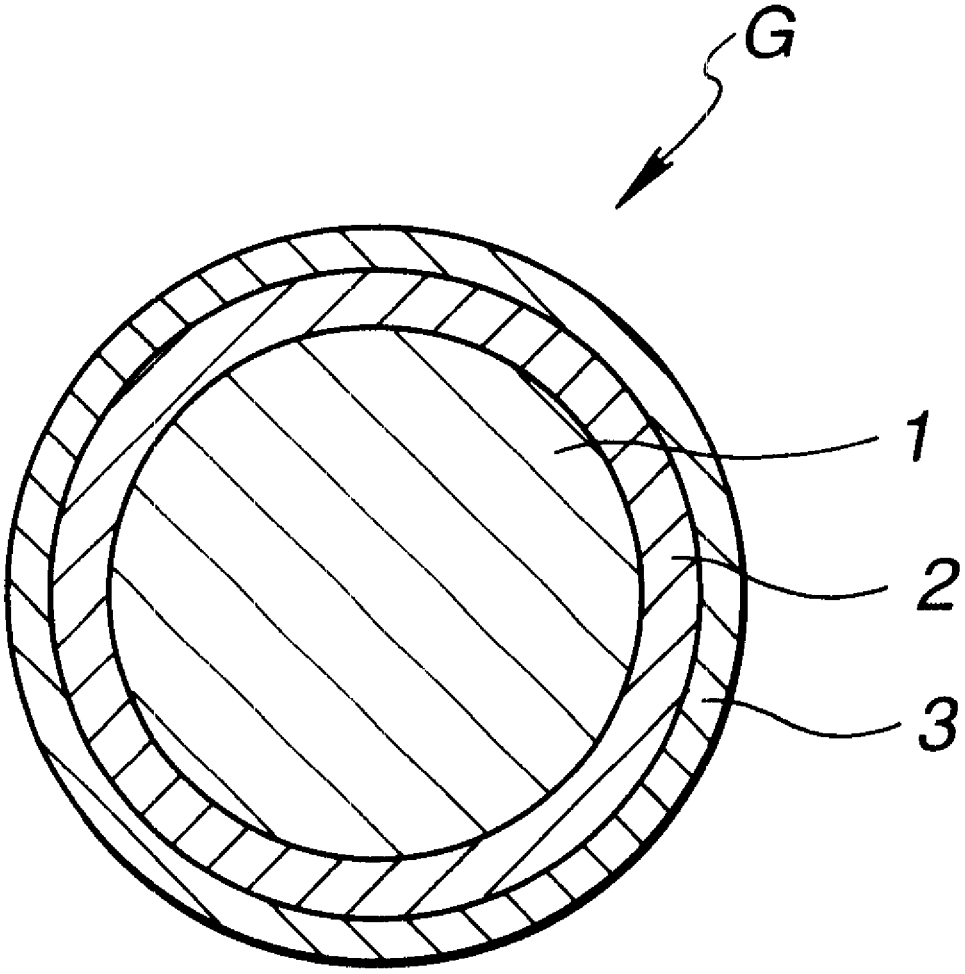
FIG. 1 is a cross-sectional view of a three-piece solid golf ball according to one embodiment of the invention.
Figure 2:
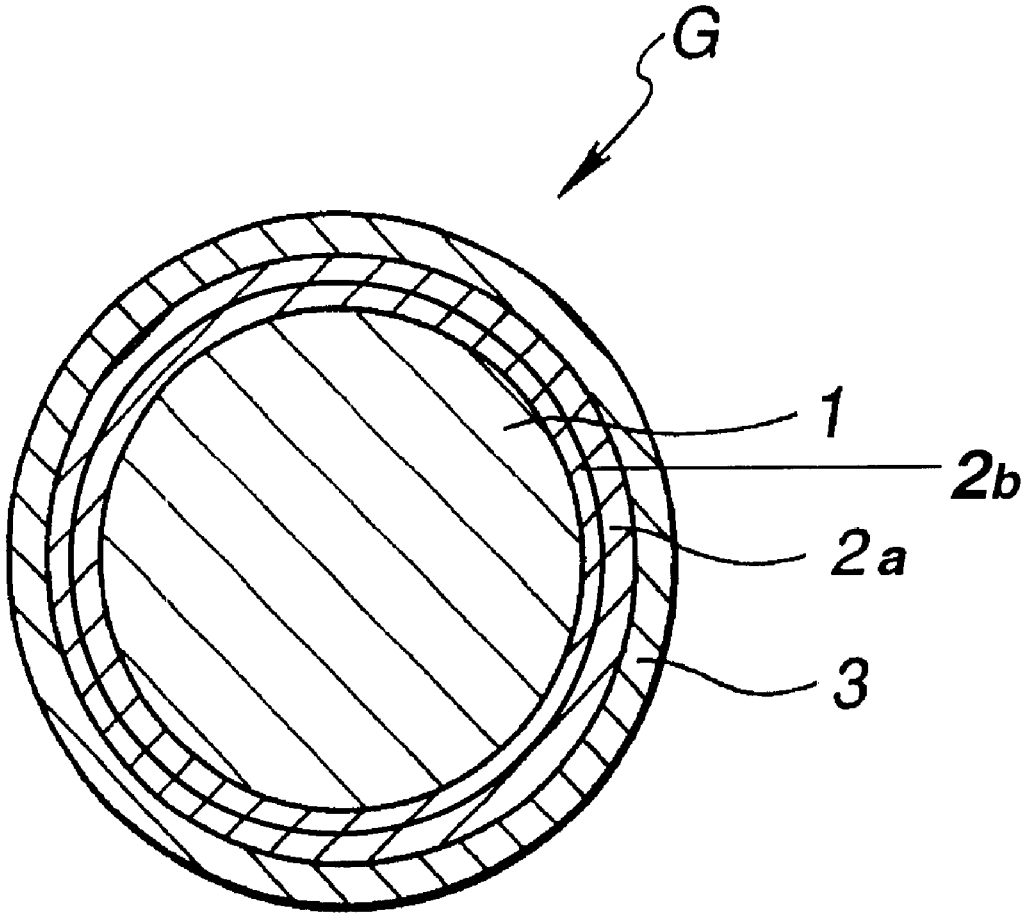
FIG. 2 is a cross-sectional view of a golf ball according to another embodiment of the invention.

Referring to FIG. 1, there is illustrated a golf ball G according to the first and second aspects of the invention. The golf ball G is constructed to a multi-layer structure having a solid core 1, an intermediate layer 2 enclosing the core 1, and a cover 3 enclosing the intermediate layer 2. The intermediate layer 2 consists of a single layer or two or more layers. The intermediate layer 2 is illustrated in FIG. 1 as a single layer, and in FIG. 2 as two layers 2*a* and 2*b*. In the first aspect, one or more layers of the intermediate layer are formed of a resin composition comprising a resin component and an appropriate amount of inorganic filler. In the second aspect, an appropriate amount of inorganic filler is added to at least one layer of the intermediate layer or the cover.

The third aspect relates to a golf ball comprising a solid core and a cover enclosing the core and consisting of at least two layers; and the fourth aspect relates to a golf ball comprising a solid core, an intermediate layer enclosing the core, and a cover enclosing the intermediate layer and consisting of at least two layers. In either of the third and fourth aspects, an appropriate amount of inorganic filler is added to the outermost layer of the cover.

In any of the first to fourth aspects, the solid core may be formed of a rubber composition primarily comprising a base rubber which is based on polybutadiene rubber, polyisoprene rubber, natural rubber or silicone rubber. Polybutadiene rubber is preferred especially for improved resilience. The preferred polybutadiene rubber is cis-1,4-polybutadiene containing at least 40% cis structure. In the base rubber, another rubber component such as natural rubber, polyisoprene rubber or styrene-butadiene rubber may be blended with the polybutadiene if desired. For high resilience, the other rubber component should preferably be less than about 10 parts by weight per 100 parts by weight of polybutadiene.

In the rubber composition, a crosslinking agent may be blended with the rubber component. Exemplary crosslinking agents are zinc and magnesium salts of unsaturated fatty acids such as zinc methacrylate and zinc acrylate, and esters such as trimethylpropane methacrylate. Of these, zinc acrylate is preferred because it can impart high resilience. The crosslinking agent is preferably used in an amount of about 15 to 40 parts by weight per 100 parts by weight of the base rubber. A vulcanizing agent such as dicumyl peroxide or 1,1-bis(t-butylperoxy)-3,3,5-trimethylcyclohexane may also be blended, preferably in an amount of about 0.1 to 5 parts by weight per 100 parts by weight of the base rubber. In the rubber composition, an antioxidant and a specific gravity adjusting filler such as zinc oxide or barium sulfate may be blended. The amount of filler blended is 0 to about 130 parts by weight per 100 parts by weight of the base rubber.

One preferred formulation of the solid core-forming rubber composition is given below.

| | Parts by weight |
|---|---|
| Cis-1,4-polybutadiene | 100 |
| Zinc oxide | 5 to 40 |
| Zinc acrylate | 15 to 40 |
| Barium sulfate | 0 to 40 |
| Peroxide | 0.1 to 5.0 |
| 1,1-bis(t-butylperoxy)-3,3,5-trimethylcyclohexane | 0.1 to 5.0 |
| Antioxidant | appropriate |

Vulcanizing conditions include a temperature of 150±10° C. and a time of about 5 to 20 minutes.

The rubber composition is obtained by kneading the above-mentioned components in a conventional mixer such as a kneader, Banbury mixer or roll mill. The resulting compound is molded in a mold by injection or compression molding.

Preferably the solid core has a diameter of 28 to 38 mm, more preferably 30 to 37 mm, and a specific gravity of 1.05 to 1.25, more preferably 1.07 to 1.23.

In the first and second aspects, the core should have a deflection of at least 3.0 mm, preferably 3.0 to 8 mm, and more preferably 3.3 to 7.0 mm, under an applied load of 100 kg. A core with a deflection of less than 3.0 mm is so hard that the feel of the ball when hit becomes hard. A core with a deflection of more than 8 mm would be too soft and substantially lose resilience. In the third and fourth aspects, the core is not limited to the above-defined hardness although the core having a hardness within the above range is preferred. The core is usually formed to a single layer structure from one material although it may also be formed to a multilayer structure of two or more layers of different materials if desired.

In the first and second aspects, the core is enclosed in the intermediate layer which is, in turn, enclosed in the cover. The intermediate layer may be formed around the core as a single layer or a plurality of layers, typically two or three layers.

The intermediate layer is composed mainly of a thermoplastic resin, examples of which include polyester elastomers, ionomer resins, styrene elastomers, urethane resins, hydrogenated butadiene and mixtures thereof. Such thermoplastic resins are commercially available under the trade name of "Himilan" from Mitsui-Dupont Polychemical K.K., "Surlyn" from Dupont, "Hytrel" from Toray-Dupont K.K., and "Pandex" from Dai-Nippon Ink & Chemicals K.K.

When the intermediate layer is formed around the core as a single layer, a material based on an ionomer resin is especially preferred. When the intermediate layer is formed around the core as two layers (a first or inside intermediate layer and a second or outside intermediate layer), it is preferred to use a material based on a relatively high hardness ionomer resin for the first intermediate layer and a softer material such as a polyester elastomer or polyurethane elastomer for the second intermediate layer. To the intermediate layer composition, there may be added antioxidants and dispersants such as metal soaps, if necessary.

Any desired method may be used in forming the intermediate layer around the core. Conventional injection or compression molding may be employed.

The cover is made of a cover stock based on a thermoplastic resin, examples of which include polyester elastomers, ionomer resins, styrene elastomers, urethane resins, hydrogenated butadiene resins and mixtures thereof.

Of these, the ionomer resins are preferred. Use may be made of commercially available ionomer resins such as Surlyn (Dupont) and Himilan (Mitsui Dupont Polychemical K.K.). To the cover stock, there may be added UV absorbers, antioxidants, and dispersants such as metal soaps, if necessary.

Any desired method may be used in forming the cover around the intermediate layer. Conventional injection or compression molding may be employed.

In the first aspect of the invention, an inorganic filler is blended in the intermediate layer. In this embodiment, the inorganic filler is substantially eliminated from the cover or only a limited amount of inorganic filler is blended in the cover.

In the second aspect of the invention, an inorganic filler is blended in at least one of the intermediate layer and the cover, and preferably both.

The inorganic filler blended herein generally has a mean particle size of 0.01 to 100 $\mu$m, preferably 0.1 to 10 $\mu$m, and more preferably 0.1 to 1.0 $\mu$m. Outside the range, larger or smaller filler particles would be difficult to disperse, failing to achieve the objects of the invention. The inorganic filler generally has a specific gravity of up to 6.5, preferably from 2.0 to 6.0. Examples of the inorganic filler include barium sulfate (specific gravity about 4.47), rutile type titanium white (specific gravity about 4.17), calcium carbonate (specific gravity about 2.6), and ultramarine for adjusting blue color. They may be used alone or in admixture of two or more.

In the embodiment wherein the inorganic filler is blended in the intermediate layer, if the intermediate layer is a single layer, the inorganic filler is added to this intermediate layer. If the intermediate layer consists of two layers, the inorganic filler is added to either one of the two layers or both.

The intermediate layer to which the inorganic filler is added is formed of a composition comprising 100 parts by weight of a resin component and 5 to 40 parts, preferably 10 to 38 parts, and more preferably 13 to 36 parts by weight of the inorganic filler. Less than 5 parts of the filler would be ineffective to provide reinforcement whereas more than 40 parts of the filler would adversely affect dispersion and resilience.

The thus molded intermediate layer in its entirety has a specific gravity of 1.0 to 1.3, preferably 1.02 to 1.28, and more preferably 1.05 to 1.26. The intermediate layer in its entirety preferably has a thickness of 0.5 to 6.0 mm, more preferably 1.0 to 5.0 mm. For the intermediate layer of two or multilayer structure, the layer having the inorganic filler added should preferably have a thickness of 0.7 to 4.0 mm, more preferably 0.8 to 3.5 mm.

The intermediate layer of single layer structure preferably has a Shore D hardness of 45 to 70, more preferably 55 to 70. For the intermediate layer of two or multilayer structure, at least one layer should preferably have a Shore D hardness of up to 55.

Around a spherical body consisting of the soft core and the inorganic filler-blended intermediate layer, is formed the cover.

In the first aspect, the inorganic filler is substantially eliminated from the cover. It is acceptable to blend a limited amount of inorganic filler in the cover. Desirably, the amount of inorganic filler is less than 8 parts, preferably less than 5 parts, and more preferably up to 3 parts by weight per 100 parts by weight of the resin component in the cover composition. When it is desired to add titanium white for increasing white color or ultramarine for adjusting blue color, the amount of such filler is preferably limited to the minimum necessary amount.

In the first aspect, the cover preferably has a specific gravity of 0.93 to 1.15, more preferably 0.93 to 1.1, and most preferably 0.93 to 1.03, a thickness of 0.5 to 2.5 mm, and more preferably 0.8 to 2.3 mm, and a Shore D hardness of 45 to 70, more preferably 55 to 70, and most preferably 58 to 68. The cover can be formed of plural layers of different materials.

In the second aspect, an appropriate amount of the inorganic filler is preferably added to the cover too. An appropriate amount of inorganic filler is 5 to 40 parts, more desirably 8 to 37 parts, and more desirably 10 to 37 parts by weight per 100 parts by weight of the resin component in the cover composition.

In the second aspect, the cover preferably has a specific gravity of 1.0 to 1.3, more preferably 1.03 to 1.28, and most preferably 1.03 to 1.1, a thickness of 0.5 to 2.5 mm, and more preferably 0.8 to 2.3 mm, and a Shore D hardness of 45 to 70, more preferably 50 to 68. The cover can be formed of plural layers of different materials.

In the third aspect, the core is directly enclosed with the cover without interleaving the intermediate layer therebetween. In the fourth aspect, the core is enclosed with the cover while the intermediate layer intervenes therebetween. In either of the third and fourth aspects, the cover is formed of at least two layers, the outermost layer of which contains an inorganic filler.

The intermediate layer is composed mainly of a thermoplastic resin, examples of which include polyester elastomers, ionomer resins, styrene elastomers, urethane resins, hydrogenated butadiene and mixtures thereof. OF these, the ionomer resins are preferred. Illustratively, commercially available ionomer resins such as Himilan from Mitsui-Dupont Polychemical K.K. and Surlyn from Dupont are useful. To the intermediate layer composition, there may be added antioxidants and dispersants such as metal soaps, if necessary.

Any desired method may be used in forming the intermediate layer around the core. Conventional injection or compression molding may be employed. The intermediate layer can be formed of plural layers of different materials.

The thus molded intermediate layer preferably has a specific gravity of 0.9 to 1.3, more preferably 0.93 to 1.25, a thickness of 0.5 to 2.5 mm, more preferably 0.7 to 2.3 mm, and a Shore D hardness of 45 to 70, more preferably 55 to 70.

The cover is formed of a cover stock primarily comprising a thermoplastic resin, examples of which include polyester elastomers, ionomer resins, styrene elastomers, urethane resins, hydrogenated butadiene and mixtures thereof. Such thermoplastic resins are commercially available under the trade name of Himilan from Mitsui-Dupont Polychemical K.K., Surlyn from Dupont, Hytrel from Toray-Dupont K.K., and Pandex from Dai-Nippon Ink & Chemicals K.K.

The cover is formed of at least two layers, preferably two or three layers. For the two layer structure consisting of inner and outer layers, the cover inner layer is formed of a relatively soft cover stock, for example, a polyester elastomer or polyurethane elastomer, and the cover outer layer is formed of a relatively hard cover stock, for example, an ionomer resin.

In the third and fourth aspects wherein the cover consists of at least two layers, an appropriate amount of an inorganic filler is blended in the outermost layer of the cover. The inorganic filler used herein is the same as described above. An appropriate amount of the inorganic filler is 10 to 40 parts, more desirably 15 to 38 parts, and more desirably 18 to 36 parts by weight per 100 parts by weight of the resin component in the cover composition. Less than 10 parts of the filler would be ineffective to exert its effect whereas more than 40 parts of the filler would adversely affect dispersion and resilience and be likely to induce weld-marks and other defects in outer appearance when injection molded. To the cover stock, there may be added UV absorbers, antioxidants, and dispersants such as metal soaps, if necessary.

The cover inner layer may be similarly formed except that the inorganic filler is not added.

Any desired method may be used in forming the cover around the core or intermediate layer. Conventional injection or compression molding may be employed.

In the two-layer structure wherein the cover consists of inner and outer layers, the cover inner layer preferably has a specific gravity of 0.9 to 1.3, more preferably 0.95 to 1.23, a thickness of 0.5 to 2.5 mm, more preferably 0.7 to 2.3 mm, and a Shore D hardness of 10 to 65, more preferably 15 to 63.

The cover outer (or outermost) layer preferably has a Shore D hardness of 53 to 70, more preferably 55 to 68, a thickness of at least 1.5 mm, more preferably 1.7 to 2.5 mm, and a specific gravity of 1.0 to 1.25, more preferably from more than 1.1 to 1.25.

In the three-layer structure wherein the cover consists of an outermost layer, a middle layer, and an inner layer, the outermost layer may be formed as is the outer layer of the two-layer structure, and the middle and inner layers may be formed as is the inner layer of the two-layer structure.

In the third and fourth aspects, a spherical body excluding the cover outermost layer (that is, a spherical body consisting of core+cover inner layer or a spherical body consisting of core+intermediate layer+cover inner layer, for example) preferably has a deflection of at least 3.0 mm, more preferably 3.0 to 8.0 mm, most preferably 3.5 to 6.5 mm, under an applied load of 100 kg. A spherical body with a deflection of less than 3.0 mm would be so hard that a ball might have a hard feel and low resilience, failing to achieve the objects of the invention.

Where the intermediate layer is provided, an appropriate amount of the inorganic filler may be added to the intermediate layer as in the embodiments of the first and second aspects.

With the above-described construction, the golf ball of the invention offers a soft and pleasant feel when hit and is significantly improved in durability against consecutive strikes.

The golf ball of the invention is provided on its surface with a multiplicity of dimples. Typically the ball surface is subject to various finish treatments including stamping and paint coating. The golf ball as a whole preferably has a hardness corresponding to a deflection of 2.6 to 5.0 mm, more preferably 3.0 to 4.8 mm, under a load of 100 kg. The golf ball must have a diameter of not less than 42.67 mm and a weight of not greater than 45.93 grams in accordance with the Rules of Golf.

EXAMPLE

Examples of the invention are given below by way of illustration and not by way of limitation. All parts are by weight.

Examples 1–4 & Comparative Examples 1–2

Core-forming rubber compositions of the formulation shown in Table 1 were mixed in a kneader and molded and vulcanized in a core mold at a temperature of 155° C. for about 15 minutes, forming solid cores.

Around the cores, the intermediate layer material and cover material of the formulation shown in Table 2 were formed by injection molding in accordance with the combination shown in Table 3, obtaining solid golf balls of Examples 1–4 and Comparative Examples 1–2. It is noted that Comparative Example 2 is a two-piece golf ball consisting of the core and the cover (lacking the intermediate layer).

The golf balls were examined for core hardness, durability against consecutive strikes, feel and outer appearance by the following tests. The results are shown in Table 3.

Core Hardness

The hardness was represented by a deflection (mm) of the core under a load of 100 kg.

Durability Against Consecutive Strikes

Using a swing robot, the ball was repeatedly struck with a driver (J's World Stage, loft angle 110, Bridgestone Sports Co., Ltd.) at a head speed of 45 m/sec. The occurrence of cracks on the ball surface was evaluated as a function of the number of strikes.

◎: no problem

○: cracks found

Δ: relatively premature failure x premature failure

Feel

Four professional golfers actually hit the ball and evaluated according to the following criterion.

◎: soft and pleasant

○: good

Δ: somewhat hard x: hard

Outer Appearance

The surface state of the as-molded ball was visually observed and evaluated according to the following criterion.

◎: very good

○: good

Δ: somewhat poor x: poor

TABLE 1

| | Solid core | | | | | |
|---|---|---|---|---|---|---|
| | Example | | | | Comparative Example | |
| | 1 | 2 | 3 | 4 | 1 | 2 |
| Cis-1,4-polybutadiene | 100 | 100 | 100 | 100 | 100 | 100 |
| Zinc acrylate | 18.0 | 16.4 | 15.8 | 15.5 | 17.7 | 26.0 |
| Dicumyl peroxide | 0.6 | 0.6 | 0.6 | 0.6 | 0.6 | 0.6 |
| Antioxidant | 0.2 | 0.2 | 0.2 | 0.2 | 0.2 | 0.2 |
| Zinc oxide | 5.0 | 5.0 | 5.0 | 5.0 | 5.0 | 10.0 |
| Barium sulfate | 26.5 | 17.4 | 32.4 | 22.8 | 34.2 | 5.2 |
| Diameter (mm) | 32.7 | 32.7 | 32.7 | 35.7 | 32.7 | 38.7 |
| Hardness (mm) | 5.5 | 6.0 | 6.0 | 6.0 | 5.5 | 2.9 |

TABLE 2

| | Intermediate layer and cover | | | | | | | | |
|---|---|---|---|---|---|---|---|---|---|
| | A | B | C | D | E | F | G | H | I |
| Himilan 1706 | 50 | — | — | — | — | — | 50 | — | 50 |
| Himilan 1605 | 50 | — | — | — | — | — | 50 | — | 50 |
| Himilan 1650 | — | 50 | — | — | — | 40 | — | — | — |
| Surlyn 1856 | — | 50 | — | — | — | 60 | — | — | — |
| Hytrel 4047 | — | — | — | — | — | — | — | 100 | — |
| Pandex EX7890 | — | — | — | 100 | — | — | — | — | — |
| Hytrel 3078 | — | — | 100 | — | 100 | — | — | — | — |
| Titanium white | — | — | — | — | — | — | 2.0 | — | 5.3 |
| Barium sulfate | 13.8 | 28.3 | 12.6 | 5.8 | 2.5 | 28.3 | — | — | 19.0 |
| Hardness (Shore D) | 65 | 60 | 30 | 40 | 30 | 58 | 65 | 40 | 65 |
| Specific gravity | 1.05 | 1.15 | 1.18 | 1.25 | 1.10 | 1.15 | 0.98 | 1.12 | 1.13 |

Himilan is the trade name of ionomer resin by Mitsui-Dupont Polychemical K.K.; Surlyn is the trade name of ionomer resin by Dupont; Hytrel is the trade name of thermoplastic polyester elastomer by Toray-Dupont K.K.; and Pandex is the trade name of polyurethane elastomer by Dai-Nippon Ink & Chemicals K.K.

TABLE 3

| | Example | | | | Comparative Example | |
|---|---|---|---|---|---|---|
| | 1 | 2 | 3 | 4 | 1 | 2 |
| Core hardness (mm) | 5.5 | 6.0 | 6.0 | 6.0 | 5.5 | 2.9 |
| Intermediate layer | | | | | | |
| Material type | A | B | A | — | G | — |
| Specific gravity | 1.05 | 1.15 | 1.05 | — | 0.98 | — |
| Thickness (mm) | 1.5 | 1.5 | 1.5 | — | 1.5 | — |
| Hardness (Shore D) | 65 | 60 | 65 | — | 65 | — |
| Material type | C | D | E | F | H | — |
| Specific gravity | 1.18 | 1.25 | 1.10 | 1.15 | 1.12 | — |
| Thickness (mm) | 1.5 | 1.5 | 1.5 | 1.5 | 1.5 | — |
| Hardness (Shore D) | 30 | 40 | 30 | 58 | 40 | — |
| Cover | | | | | | |
| Material type | G | G | G | G | G | I |
| Specific gravity | 0.98 | 0.98 | 0.98 | 0.98 | 0.98 | 1.13 |
| Thickness (mm) | 2.0 | 2.0 | 2.0 | 2.0 | 2.0 | 2.0 |
| Hardness (Shore D) | 65 | 65 | 65 | 65 | 65 | 65 |
| Ball | | | | | | |
| Durability | ◎ | ◎ | ◎ | ◎ | Δ | Δ |
| Feel | ◎ | ◎ | ◎ | ◎ | ◎ | x |
| Appearance | ◎ | ◎ | ◎ | ◎ | ◎ | Δ |

As seen from Table 3, the ball of Comparative Example 1 wherein only 2 parts of the inorganic filler was added to the first intermediate layer and the inorganic filler was not added to the second intermediate layer was less durable against consecutive strikes. The ball of Comparative Example 2 which was a conventional two-piece ball consisting of a core and a cover was poor in durability against consecutive strikes and outer appearance and had a very poor feel because a large amount of the inorganic filler was added to the cover.

In contrast, the balls of Examples 1–4 wherein the intermediate layer of one or two layers having an appropriate amount of inorganic filler added thereto was formed around the soft core were improved in durability against consecutive strikes, outer appearance and feel.

Examples 5–8 & Comparative Examples 3–4

Core-forming rubber compositions of the formulation shown in Table 4 were mixed in a kneader and molded and vulcanized in a core mold at a temperature of 155° C. for about 15 minutes, forming solid cores.

Around the cores, the intermediate layer material and cover material of the formulation shown in Table 2 were formed by injection molding in accordance with the combination shown in Table 5, obtaining solid golf balls of Examples 5–8 and Comparative Examples 3–4. It is noted that Comparative Example 4 is a two-piece golf ball consisting of the core and the cover (lacking the intermediate layer).

The golf balls were examined for core hardness, durability against consecutive strikes, feel and outer appearance by the same tests as above. The results are shown in Table 5.

TABLE 4

| | Solid core | | | | | |
|---|---|---|---|---|---|---|
| | Example | | | | Comparative Example | |
| | 5 | 6 | 7 | 8 | 3 | 4 |
| Cis-1,4-polybutadiene | 100 | 100 | 100 | 100 | 100 | 100 |
| Zinc acrylate | 18.3 | 16.7 | 16.0 | 15.9 | 17.7 | 26.0 |
| Dicumyl peroxide | 0.6 | 0.6 | 0.6 | 0.6 | 0.6 | 0.6 |
| 1,1-bis(t-butyl-peroxy)-3,3,5-trimethylcyclohexane | 0.6 | 0.6 | 0.6 | 0.6 | 0.6 | 0.25 |
| Antioxidant | 0.2 | 0.2 | 0.2 | 0.2 | 0.2 | 0.2 |
| Zinc oxide | 5.0 | 5.0 | 5.0 | 5.0 | 5.0 | 10.0 |
| Barium sulfate | 19.5 | 10.9 | 25.5 | 17.6 | 34.2 | 5.2 |
| Diameter (mm) | 32.7 | 32.7 | 32.7 | 35.7 | 32.7 | 38.7 |
| Hardness (mm) | 5.5 | 6.0 | 6.0 | 6.0 | 5.5 | 2.9 |

TABLE 5

| | Example | | | | Comparative Example | |
|---|---|---|---|---|---|---|
| | 5 | 6 | 7 | 8 | 3 | 4 |
| Core hardness (mm) | 5.5 | 6.0 | 6.0 | 6.0 | 5.5 | 2.9 |
| Intermediate layer | | | | | | |
| Material type | A | B | A | — | G | — |
| Specific gravity | 1.05 | 1.15 | 1.05 | — | 0.98 | — |
| Thickness (mm) | 1.5 | 1.5 | 1.5 | — | 1.5 | — |
| Hardness (Shore D) | 65 | 60 | 65 | — | 65 | — |
| Material type | C | D | E | F | H | — |
| Specific gravity | 1.18 | 1.25 | 1.10 | 1.15 | 1.12 | — |
| Thickness (mm) | 1.5 | 1.5 | 1.5 | 1.5 | 1.5 | — |
| Hardness (Shore D) | 30 | 40 | 30 | 58 | 40 | — |

TABLE 5-continued

| | Example | | | | Comparative Example | |
|---|---|---|---|---|---|---|
| | 5 | 6 | 7 | 8 | 3 | 4 |
| Cover | | | | | | |
| Material type | A | A | A | A | G | I |
| Specific gravity | 1.05 | 1.05 | 1.05 | 1.05 | 0.98 | 1.13 |
| Thickness (mm) | 2.0 | 2.0 | 2.0 | 2.0 | 2.0 | 2.0 |
| Hardness (Shore D) | 65 | 65 | 65 | 65 | 65 | 65 |
| Ball | | | | | | |
| Durability | ◎ | ◎ | ◎ | ◎ | Δ | Δ |
| Feel | ◎ | ◎ | ◎ | ◎ | ◎ | x |
| Appearance | ◎ | ◎ | ◎ | ◎ | ◎ | Δ |

Examples 9–12 & Comparative Examples 5–7

Core-forming rubber compositions of the formulation shown in Table 6 were mixed in a kneader and molded and vulcanized in a core mold at a temperature of 155° C. for about 15 minutes, forming solid cores.

Around the cores, the intermediate layer material and cover material of the formulation shown in Table 7 were formed by injection molding in accordance with the combination shown in Table 8, obtaining solid golf balls of Examples 9–12 and Comparative Examples 5–7. It is noted that Comparative Examples 5–7 are two-piece golf balls consisting of the core and the cover (lacking the intermediate layer and cover inner layer).

The golf balls were examined for core hardness, durability against consecutive strikes, feel and outer appearance by the same tests as above. The hardness of a spherical body exclusive of the cover outer layer was also measured as follows. The results are shown in Table 8.

Hardness of Spherical Body

The hardness of a spherical body obtained by excluding the cover outer layer from the ball (which was the core in the case of a two-piece ball) was represented by a deflection (mm) of the body under a load of 100 kg.

TABLE 6

| | Solid core | | | | | | |
|---|---|---|---|---|---|---|---|
| | Example | | | | Comparative Example | | |
| | 9 | 10 | 11 | 12 | 5 | 6 | 7 |
| Cis-1,4-polybutadiene | 100 | 100 | 100 | 100 | 100 | 100 | 100 |
| Zinc acrylate | 18.2 | 16.6 | 16.4 | 21.8 | 26.0 | 24.5 | 18.5 |
| Dicumyl peroxide | 0.6 | 0.6 | 0.6 | 0.6 | 0.6 | 0.6 | 0.6 |
| Antioxidant | 0.2 | 0.2 | 0.2 | 0.2 | 0.2 | 0.2 | 0.2 |
| Zinc oxide | 5.0 | 5.0 | 5.0 | 5.0 | 5.0 | 5.0 | 5.0 |
| Barium sulfate | 21.8 | 13.4 | 16.9 | 15.6 | 7.6 | 2.7 | 16.9 |
| Diameter (mm) | 32.7 | 32.7 | 32.7 | 35.7 | 39.1 | 40.3 | 40.3 |
| Hardness (mm) | 5.5 | 6.0 | 6.0 | 4.0 | 2.8 | 3.0 | 3.8 |

TABLE 7

| | Intermediate layer and cover | | | | | | | |
|---|---|---|---|---|---|---|---|---|
| | a | b | c | d | e | f | g | h |
| Himilan 1706 | 50 | — | — | — | 50 | 50 | 50 | 50 |
| Himilan 1605 | 50 | — | — | — | 50 | 50 | 50 | 50 |

TABLE 7-continued

| | Intermediate layer and cover | | | | | | | |
|---|---|---|---|---|---|---|---|---|
| | a | b | c | d | e | f | g | h |
| Himilan 1650 | — | 50 | — | — | — | — | — | — |
| Surlyn 1856 | — | 50 | — | — | — | — | — | — |
| Pandex EX7890 | — | — | — | 100 | — | — | — | — |
| Hytrel 3078 | — | — | 100 | — | — | — | — | — |
| Titanium white | 2.0 | — | — | — | 2.0 | 2.0 | 2.0 | 2.0 |
| Barium sulfate | — | — | — | — | 25.4 | 28.3 | 34.4 | 67.2 |
| Hardness (Shore D) | 65 | 60 | 30 | 40 | 65 | 65 | 65 | 65 |
| Specific gravity | 0.98 | 0.98 | 1.07 | 1.20 | 1.13 | 1.15 | 1.19 | 1.39 |

Himilan is the trade name of ionomer resin by Mitsui-Dupont Polychemical K.K.; Surlyn is the trade name of ionomer resin by Dupont; Hytrel is the trade name of thermoplastic polyester elastomer by Toray-Dupont K.K.; and Pandex is the trade name of polyurethane elastomer by Dai-Nippon Ink & Chemicals K.K.

TABLE 8

| | Example | | | | Comparative Example | | |
|---|---|---|---|---|---|---|---|
| | 9 | 10 | 11 | 12 | 5 | 6 | 7 |
| Core hardness (mm) | 5.5 | 6.0 | 6.0 | 4.0 | 2.8 | 3.0 | 3.8 |
| Intermediate layer | | | | | | | |
| Material type | a | b | a | — | — | — | — |
| Specific gravity | 0.98 | 0.98 | 0.98 | — | — | — | — |
| Thickness (mm) | 1.5 | 1.5 | 1.5 | — | — | — | — |
| Hardness (Shore D) | 65 | 60 | 65 | — | — | — | — |
| Cover inner layer | | | | | | | |
| Material type | c | d | c | b | — | — | — |
| Specific gravity | 1.07 | 1.20 | 1.07 | 0.98 | — | — | — |
| Thickness (mm) | 1.5 | 1.5 | 1.5 | 1.5 | — | — | — |
| Hardness (Shore D) | 30 | 40 | 30 | 60 | — | — | — |
| Hardness of spherical body (mm) | 4.0 | 4.3 | 4.3 | 3.5 | 2.8 | 3.0 | 3.8 |
| Cover outer layer | | | | | | | |
| Material type | e | f | g | f | f | h | a |
| Specific gravity | 1.13 | 1.15 | 1.19 | 1.15 | 1.15 | 1.39 | 0.98 |
| Thickness (mm) | 2.0 | 2.0 | 2.0 | 2.0 | 1.8 | 1.2 | 1.2 |
| Hardness (Shore D) | 65 | 65 | 65 | 65 | 65 | 65 | 65 |
| Ball | | | | | | | |
| Durability | ◎ | ◎ | ◎ | ◎ | ○ | ○ | x |
| Feel | ◎ | ◎ | ◎ | ◎ | x | Δ | x |
| Appearance | ◎ | ◎ | ◎ | ◎ | ○ | x | ○ |

Japanese Patent Application Nos. 10-224711, 10-224704, and 10-224698 are incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball comprising a core, an intermediate layer consisting of one or more layers around the core, and a cover formed mainly of a thermoplastic resin around the intermediate layer, said core being formed mainly of a rubber base and having a deflection of at least 3.0 mm under an applied load of 100 kg, at least one layer of said intermediate layer comprising 100 parts by weight of a resin component and 5 to 40 parts by weight of an inorganic filler; and wherein said intermediate layer has a specific gravity of 1.0 to 1.3.

2. The golf ball of claim 1 wherein said intermediate layer has a thickness of 0.5 to 6.0 mm.

3. The golf ball of claim 1, wherein said intermediate layer is composed mainly of a thermoplastic resin, which includes polyester elastomers, ionomer resins, styrene elastomers, urethane resins, hydrogenated butadiene and mixtures thereof.

4. The golf ball of claim 1, wherein said intermediate layer is formed of one layer made of a material based on an ionomer resin.

5. The golf ball of claim 1, wherein said intermediate layer is formed of two layers consisting of a first intermediate layer and a second intermediate layer, and said first intermediate layer is formed of a relatively high hardness ionomer resin and said second intermediate layer is formed of a softer material such as a polyester elastomer or polyurethane elastomer.

6. The golf ball of claim 2, wherein said cover has a Shore D hardness of 45 to 70.

7. The golf ball of claim 5, wherein said cover has a Shore D hardness of 45 to 70 and harder than that of the second intermediate layer.

8. The golf ball of claim 1, wherein said cover has a thickness of 0.5 to 2.5 mm.

9. The golf ball of claim 2, wherein said cover has a thickness of 0.5 to 2.5 mm.

10. A golf ball comprising a core, an intermediate layer consisting of one or more layers around the core, and a cover formed mainly of a thermoplastic resin around the intermediate layer, said core being formed mainly of a rubber base and having a deflection of at least 3.0 mm under an applied load of 100 kg, at least one layer of said intermediate layer and said cover having added thereto an inorganic filler, said cover having a specific gravity of 1.0 to 1.3; and wherein at least one layer of said intermediate layer contains 100 parts by weight of a resin component and 5 to 40 parts by weight of an inorganic filler.

11. The golf ball of claim 10 wherein said intermediate layer has a specific gravity of 1.0 to 1.3.

12. The golf ball of claim 10 wherein said intermediate layer has a thickness of 0.5 to 6.0 mm.

13. The golf ball of claim 10, wherein said cover is formed of a cover stock primarily comprising a thermoplastic resin which includes polyester elastomers, ionomer resins, styrene elastomers, urethane resins, hydrogenated butadiene and mixtures thereof.

14. The golf ball of claim 10, wherein said intermediate layer is formed of two layers consisting of a first intermediate layer and a second intermediate layer, and said cover has a Shore D hardness harder than said second intermediate layer.

15. The golf ball of claim 10, wherein said at least one layer of said intermediate layer has a Shore D hardness of 55 to 70.

16. The golf ball of claim 10, wherein said intermediate layer comprises a resin component.

17. The golf ball of claim 12, wherein said cover has a thickness of 0.5 to 2.0 mm.

18. A golf ball comprising a core, an intermediate layer consisting of one or more layers around the core, and a cover formed mainly of a thermoplastic resin around the intermediate layer, said core being formed mainly of a rubber base and having a deflection of at least 3.0 mm under an applied load of 100 kg, at least one layer of said intermediate layer and said cover having added thereto an inorganic filler, said cover having a specific gravity of 1.0 to 1.3; and wherein said cover contains 100 parts by weight of a resin component and 5 to 40 parts by weight of an inorganic filler.

19. A golf ball comprising a core, an intermediate layer consisting of one or more layers around the core, and a cover formed mainly of a thermoplastic resin around the intermediate layer, said core being formed mainly of a rubber base and having a deflection of at least 3.0 mm under an applied load of 100 kg, at least one layer of said intermediate layer comprising 100 parts by weight of a resin component and 5 to 40 parts by weight of an inorganic filler; and wherein said inorganic filler has a specific gravity of up to 6.5 and a mean particle size of 0.1 to 10 $\mu$m.

20. The golf ball of claim 19, wherein said intermediate layer has a specific gravity of 1.0 to 1.3.

21. The golf ball of claim 19, wherein said intermediate layer has a thickness of 0.5 to 6.0 mm.

22. The golf ball of claim 19, wherein said intermediate layer is composed mainly of a thermoplastic resin, which includes polyester elastomers, ionomer resins, styrene elastomers, urethane resins, hydrogenated butadiene and mixtures thereof.

23. The golf ball of claim 19, wherein said intermediate layer is formed of one layer made of a material based on an ionomer resin.

24. The golf ball of claim 19, wherein said intermediate layer is formed of two layers consisting of a first intermediate layer and a second intermediate layer, and said first intermediate layer is formed of a relatively high hardness ionomer resin and said second intermediate layer is formed of a softer material such as a polyester elastomer or polyurethane elastomer.

25. The golf ball of claim 19, wherein said cover has a Shore D hardness of 45 to 70.

26. The golf ball of claim 19, wherein said at least one layer of said intermediate layer has a Shore D hardness of 55 to 70.

27. The golf ball of claim 19, wherein said cover has a thickness of 0.5 to 2.5 mm.

28. A golf ball comprising a core, an intermediate layer consisting of one or more layers around the core, and a cover formed mainly of a thermoplastic resin around the intermediate layer, said core being formed mainly of a rubber base and having a deflection of at least 3.0 mm under an applied load of 100 kg, at least one layer of said intermediate layer and said cover having added thereto an inorganic filler, said cover having a specific gravity of 1.0 to 1.3; and wherein said inorganic filler has a specific gravity of up to 6.5 and a mean particle size of 0.1 to 10 $\mu$m.

29. The golf ball of claim 28, wherein at least one layer of said intermediate layer contains 100 parts by weight of a resin component and 5 to 40 parts by weight of an inorganic filler.

30. The golf ball of claim 28, wherein said intermediate layer has a specific gravity of 1.0 to 1.3.

31. The golf ball of claim 28, wherein said intermediate layer has a thickness of 0.5 to 6.0 mm.

32. The golf ball of claim 28, wherein said cover contains 100 parts by weight of a resin component and 5 to 40 parts by weight of an inorganic filler.

33. The golf ball of claim 28, wherein said cover is formed of a cover stock primarily comprising a thermoplastic resin which includes polyester elastomers, ionomer resins, styrene elastomers, urethane resins, hydrogenated butadiene and mixtures thereof.

34. The golf ball of claim 28, wherein said intermediate layer is formed of two layers consisting of a first intermediate layer and a second intermediate layer, and said cover has a Shore D hardness harder than said second intermediate layer.

35. The golf ball of claim 28, wherein said at least one layer of said intermediate layer has a Shore D hardness of 55 to 70.

36. The golf ball of claim 28, wherein said intermediate layer comprises a resin component.

37. A golf ball comprising a core, an intermediate layer consisting of one or more layers around the core, and a cover formed mainly of a thermoplastic resin around the intermediate layer, said core being formed mainly of a rubber base and having a deflection of at least 3.0 mm under an applied load of 100 kg, at least one layer of said intermediate layer comprising 100 parts by weight of a resin component and 5 to 40 parts by weight of an inorganic filler; and wherein said at least one layer of said intermediate layer has a Shore D hardness of 55 to 70.

38. The golf ball of claim 37, wherein said at least one layer of said intermediate layer has a specific gravity of 1.0 to 1.3.

* * * * *